United States Patent [19]

Eisenhut et al.

[11] Patent Number: 4,701,112

[45] Date of Patent: Oct. 20, 1987

[54] PUMPING SYSTEM

[75] Inventors: Wolfgang O. Eisenhut, Woodside; John W. Senf, San Carlos, both of Calif.

[73] Assignee: Adhesive Engineering Company, San Carlos, Calif.

[21] Appl. No.: 914,711

[22] Filed: Oct. 2, 1986

[51] Int. Cl.[4] ..... F04B 17/00; F04B 35/00

[52] U.S. Cl. ..... 417/345; 417/403; 417/426

[58] Field of Search ..... 417/403, 345, 426; 91/276

[56] References Cited

U.S. PATENT DOCUMENTS

| | | | |
|---|---|---|---|
| 2,679,208 | 5/1954 | Euverard | 103/49 |
| 2,768,815 | 10/1955 | Weaver | 259/8 |
| 3,234,882 | 2/1966 | Douglas | 91/275 |
| 3,250,247 | 5/1966 | Beaman | 417/403 |
| 3,330,211 | 7/1967 | Faro et al. | 417/403 |
| 4,028,014 | 6/1977 | Cocks | 417/403 |
| 4,176,586 | 12/1979 | Stoll | 91/275 |
| 4,391,571 | 7/1983 | Craggs | 91/275 |
| 4,527,959 | 7/1985 | Whiteman | 417/427 |
| 4,545,736 | 10/1985 | Walton | 417/63 |
| 4,547,134 | 10/1985 | Hirvonen | 417/349 |
| 4,621,496 | 11/1986 | Lamb | 417/426 |

FOREIGN PATENT DOCUMENTS

| | | | |
|---|---|---|---|
| 1475855 | 6/1977 | United Kingdom | 417/403 |

*Primary Examiner*—William L. Freeh

*Attorney, Agent, or Firm*—Robert R. Tipton

[57] ABSTRACT

A multiple fluid pumping system uses two or more fluid pumps each driven by a pneumatic piston or plunger and cylinder combination whose piston top stroke and bottom stroke positions are detected by reed switches in combination with a magnet attached to the piston. The top stroke reed switches are connected in series with one side of a two position pneumatic solenoid valve while the bottom stroke reed switches are connected in series with the other side of a two position penumatic solenoid valve. The circuit is designed to prevent one of the pistons from changing the direction of its stroke prior to the other piston reaching the end of its stroke. A further embodiment utilizes a magnet mounted on one pneumatically driven piston or plunger and a pair of reed switches mounted on the other penumatically driven piston or plunger to prevent one piston or plunger from moving faster or slover than the other piston or plunger.

1 Claim, 4 Drawing Figures

PUMPING SYSTEM

BACKGROUND OF THE PRIOR ART

This invention relates generally to multiple fluid pumps, and in particular to multiple fluid pumps requiring an accurate ratioing of fluids being pumped.

A number of pumping systems of the prior art used devices to detect the end of stroke of the piston.

These devices for detecting the end of the piston stroke included toggle switches, induction switches and proximity switches of various types. The primary purpose of these devices was to count the number of piston strokes and thus measure the volume of fluid pumped knowing the piston diameter and length of stroke.

All of the prior art systems were designed to pump a single fluid or slurry.

They were not interested in accurate ratioing of two or more fluids.

Those devices that were interested in ratioing of two or more fluids utilized, variously, pumps which were mechanically geared together to cause them to pump at different rates.

When pumping fluids of different viscosities, these mechanically configured pumping systems could not accurately ratio the fluids at all pumping speeds without taking into consideration special design features relative to the differences in viscosity of each fluid.

For these prior art multiple fluid pumping systems, it was extremely difficult to change the pumping ratio.

SUMMARY OF THE INVENTION

A first component pump and a second component pump are driven by separate pneumatically actuated piston and cylinder combinations, each pneumatic piston comprising a magnet attached thereto with a pair of top and bottom stroke reed switches spaced apart along the exterior of the pneumatic cylinder for detecting the respective top and bottom stroke position of the piston. The top stroke reed switches are connected in series to the top stroke coil of a two position pneumatic solenoid valve while the bottom stroke reed switches are connected in series to the bottom stroke coil of the two-position pneumatic solenoid valve. An air supply is connected to the air input side of the two-position solenoid valve. The outlet side of the solenoid valve associated with the top stroke solenoid coil is connected in fluid communication with the top end of the two pneumatic cylinders while the outlet side of the two-position solenoid valve associated with the bottom stroke solenoid coil is connected in fluid communication with bottom end of the two pneumatic cylinders. Means are provided for adjusting the length of stroke of the piston of each piston and cylinder combination.

It is, therefore, an object of the present invention to provide a multiple fluid pumping system, It is a further object of the present invention for provide a multiple fluid pumping system in which the ratioing of the fluids is adjustable.

It is still a further object of the present invention to provide a multiple fluid pumping system in which viscosity of the fluids does not affect accuracy of ratioing or operation of the system.

It is another object of the present invention to provide a multiple fluid pump utilizing a pneumatic actuating system for the fluid pumps.

These and other objects of the present invention will become manifest upon study of the following detailed description when taken together with the drawings.

DESCRIPTION OF THE PREFERRED EMBODIMENT

Figure 1:
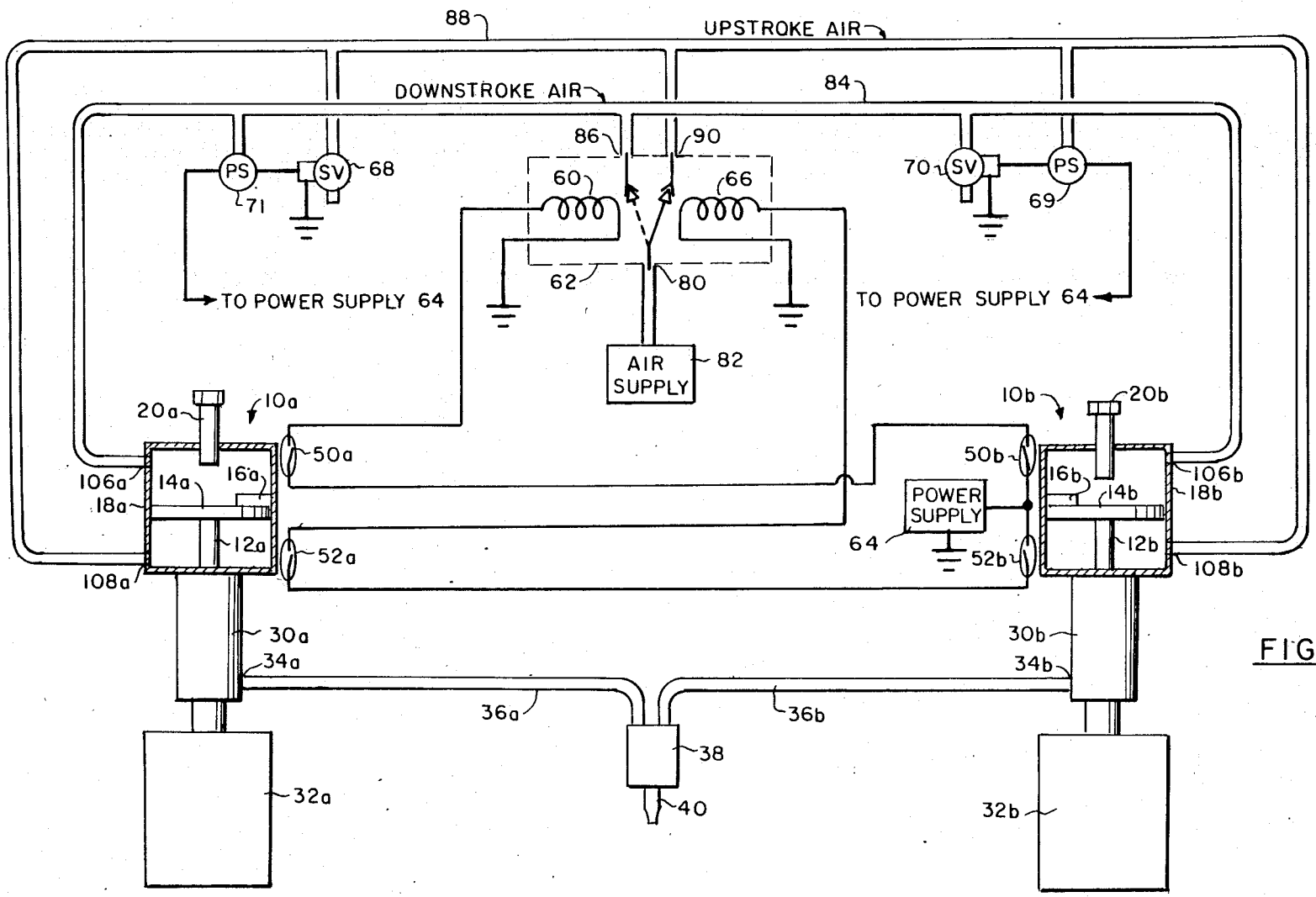
FIG. 1 is a schematic diagram of the multiple fluid pumping system of the present invention showing the general configuration and relationship of the operating elements to each other.

With reference to FIG. 1, there is illustrated a schematic diagram of the multiple fluid pumping system of the present invention comprising, basically, a first pneumatic piston and cylinder combination 10*a* and a second pneumatic piston and cylinder combination 10*b*.

Figure 2:
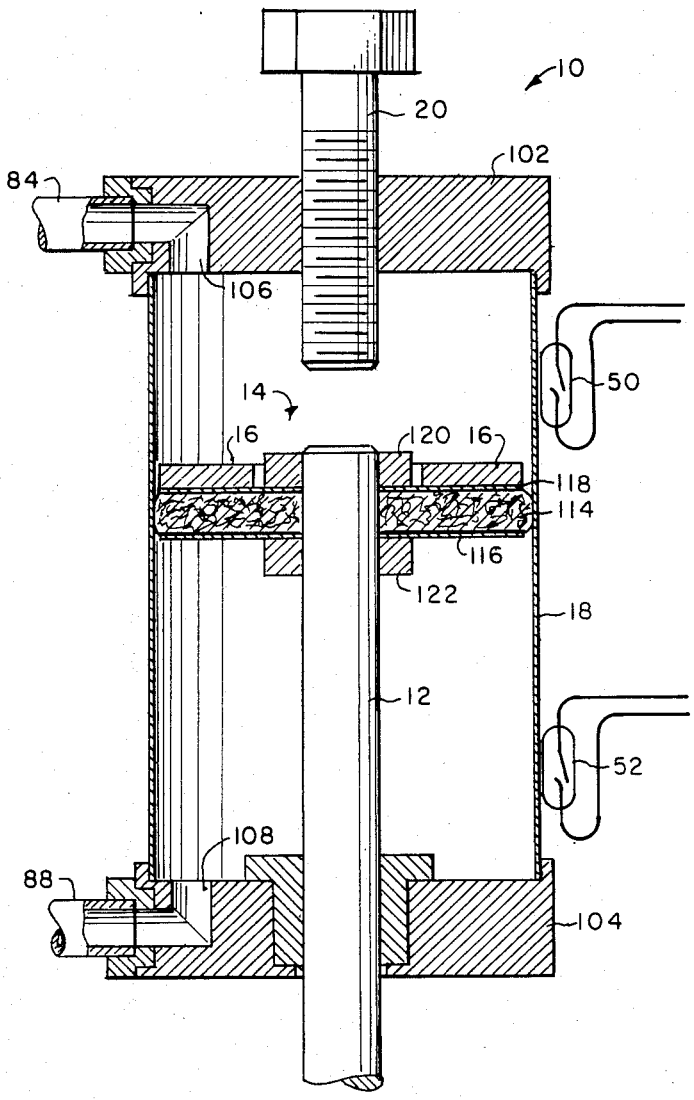
FIG. 2 is a cross-sectional, elevational view of the pneumatic piston and cylinder combination used to operate the positive displacement fluid pumps.

The two pneumatic piston and cylinder combinations 10*a* and 10*b* are identical. The corresponding structural elements of each pneumatic piston and cylinder combination and equipment operated thereby, are identified by the same number, however, with the letter suffix "a" or "b" depending upon whether it is first pneumatic piston and cylinder combination 10*a* or second piston and cylinder combination 10*b*. In FIG. 2, the letter suffixes "a" and "b" are not used when identifying corresponding elements of the pneumatic piston and cylinder combinations 10*a* and 10*b* of FIGS. 1 and 3.

First piston and cylinder combination 10*a* comprises, basically a piston rod 12*a* connected to piston 14*a* on which is attached a magnet 16*a*, a cylinder 18*a* and an adjustment screw 20*a* proximate the top of cylinder 18*a* used to adjust the end of the top of stroke of piston 14*a*.

Piston rod 12*a* of first piston and cylinder combination 10*a* is used to actuate positive displacement pump 30*a* which is in fluid communication with liquid containing reservoir 32*a*.

In a like manner, second piston and cylinder combination 10*b* actuates positive displacement pump 30*b* which is in fluid communication with liquid containing reservoir 32*b*.

The outlet port 34*a* of positive displacement pump 30*a* feeds into conduit 36*a* as does outlet port 34*b* of positive displacement pump 30*b*.

The two fluids coming in opposite directions in conduit 36 from pumps 30*a* and 30*b* are fed into static mixing chamber 38 there they are mixed together prior to being ejected from nozzle 40.

The system for controlling pneumatic piston and cylinder combinations 10*a* and 10*b* comprises, basically, a first top stroke reed switch 50*a* located proximate the top of cylinder 18*a* adjacent piston 14*a* and magnet 16*a* when piston 14*a* reaches the top of its stroke, and a bottom stroke reed switch 52*a* located proximate the bottom of cylinder 18*a* adjacent magnet 16*a* when piston 14*a* reaches the bottom of its stroke.

A similar configuration of reed switches is arranged for piston and cylinder combination 20*b*.

Reed switches 50*a*, 50*b*, 52*a* and 52*b* are used to control the supply of air to piston and cylinder combinations 10*a* and 10*b*.

The specific function is to prevent the piston in one of the piston and cylinder combinations from beginning its return stroke until the piston in the other piston and cylinder combination has completed its corresponding stroke.

To accomplish this function, top stroke reed switch 50*a*, top stroke reed switch 50*b* and down stroke coil 60 of two-position pneumatic solenoid valve 62 and connected in series for power supply 64. Up stroke air vent solenoid valve 68 is connected in parallel with down stroke coil 60 in order to vent air from the bottom of cylinders 18*a* and 18*b*.

In a like manner, bottom stroke reed switch 52*a*, bottom stroke reed switch 52*b* and up stroke coil 66 of two-position solenoid valve 62 are connected in series to power supply 64. Down stroke air vent solenoid valve 70 is connected in parallel wth up stroke coil 66 in order to vent air from the top of cylinders 18*a* and 18*b*.

Air is supplied to inlet port 80 of two-position pneumatic solenoid valve 62 from air supply 82.

Downstroke air is supplied to downstroke air conduit 84 from outlet port 86 of two-position pneumatic solenoid valve 62.

Upstroke air is supplied to upstroke air conduit 88 from outlet port 90 of two-position pneumatic solenoid valve 62.

Downstroke air conduit 84 fluidly communicates outlet port 86 with the top of respective cylinders 18*a* and 18*b*, while upstroke air conduit 88 fluidly communicates outlet port 90 with the bottom of respective cylinders 18*a* and 18*b*.

With reference to FIG. 2, there is illustrated as cross-sectional, elevational view of a typical pneumatic piston and cylinder combination 10*a* and 10*b*, identified in FIG. 2 merely as pneumatic piston and cylinder combination 10.

As previously described, piston and cylinder combination 10 comprises a piston rod 12 connected to piston 14 to which is attached magnet 16, all of which is enclosed in cylinder 18.

In addition, piston and cylinder combination 10 further comprises a top cap 102 hermetically sealed to the top of cylinder 18 and a bottom cap 104 hermetically sealed to the bottom of cylinder 18.

Piston stroke adjustment screw 20 is adapted to pass through and engage the center of top cap 102.

Downstroke air inlet port 106 is provided in top cap 102 and is connected to be in fluid communication with downstroke air conduit 84.

Upstroke air inlet port 108 is provided in bottom cap 104 and is connected to be in fluid communication with upstroke air conduit 88.

Piston 14 comprises a packing seal member 114 sandwiched between pressure plates 116 and 118. By tightening nut 120, pressure is applied to plates 116 and 118 and packing 114 against collar 122.

Magnet 16 is shown in FIG. 2 as an annular ring attached to pressure plate 118 in which the magnetic field is adapted to extend radially outward for detection by and actuation of reed switches 50 and 52 when adjacent their location.

Operation

To operate the multiple fluid pumping system of the present invention, air is supplied from air supply 82 to inlet port 80 of two-position pneumatic solenoid valve 62 and is directed, as shown in FIG. 1, to upstroke outlet port 90 by energizing upstroke coil 66 of pneumatic two-position solenoid valve 62.

Air pressure is thus provided to upstroke conduit 88. Upon detection of air pressure in upstroke conduit 88 by pressure switch 69, normally closed pneumatic solenoid valve 70 is actuated to the open position in order to allow air in upper part cylinders 18*a* and 18*b* to vent to the atmosphere.

Air is thus supplied by conduit 88 to inlet ports 108*a* and 108*b* proximate the bottom of pneumatic piston and cylinder combinations 10*a* and 10*b*, respectively, causing respective piston 14*a* and 14*b* to begin their up stroke. As piston 14*a* and 14*b* rise in their respective cylinders 18*a* and 18*b*, fluid from reservoirs 32*a* and 32*b* are drawn into positive displacement pumps 30*a* and 30*b*, respectively.

Since adjustment screws 20*a* and 20*b* may be set at different point to stop the upward travel of pistons 14*a* and 14*b*, and since friction forces for each piston and cylinder combination and positive displacement pump may be different, either piston 14*a* or 14*b* may arrive at its top position before the other.

For example, if piston 14*b* arrived at its top position prior to piston 14*a*, reed switch 50*b* would be actuated by magnet 16*b* to the closed position.

Since piston 14*a* has not yet reached its top position, magnet 16*a* has not yet actuated reed switch 50*a*, thus it remains open.

Since reed switches 50*a* and 50*b* are connected in series, no current flows to downstroke coil 60 of pneumatic two-position solenoid valve 62.

When piston 14*a* reaches its top position, reed switch 50*a* is actuated to the closed position thus completing the circuit to downstroke coil 60 of two-position pneumatic air valve 62 and switching air from upstroke outlet port 90 to downstroke outlet port 86.

Air is then supplied by downstroke air conduit 84 to the top end of cylinders 18*a* and 18*b* through inlet ports 106*a* and 106*b*, respectively, causing pistons 14*a* and 14*b* to change direction and travel downwardly driving fluids in positive displacement pumps 30*a* and 30*b* into conduit 36 to be mixed together in static mixing chamber 38 prior to ejection from nozzle 40.

In a like manner, as described when the pistons reach the top of their stroke, as pistons 14*a* and 14*b* approach the bottom of their stroke proximate reed switches 52*a* and 52*b*, respectively, should piston 14*a* arrive at the bottom of its stroke first and actuate reed switch 14*a* first, because reed switch 14*b* if still open, and since reed switches 52*a* and 52*b* are connected in series, no current is able to reach upstroke coil 66 of two-position pneumatic solenoid air valve 62.

The moment reed switch 52*b* is actuated to the closed position by magnet 16*b* attached to piston 14*b*, the circuit to coil 66 is closed and two-position pneumatic solenoid valve 62 is switched to cause air to now flow out of upstroke outlet port 90 to repeat the pumping cycle.

Figure 3:
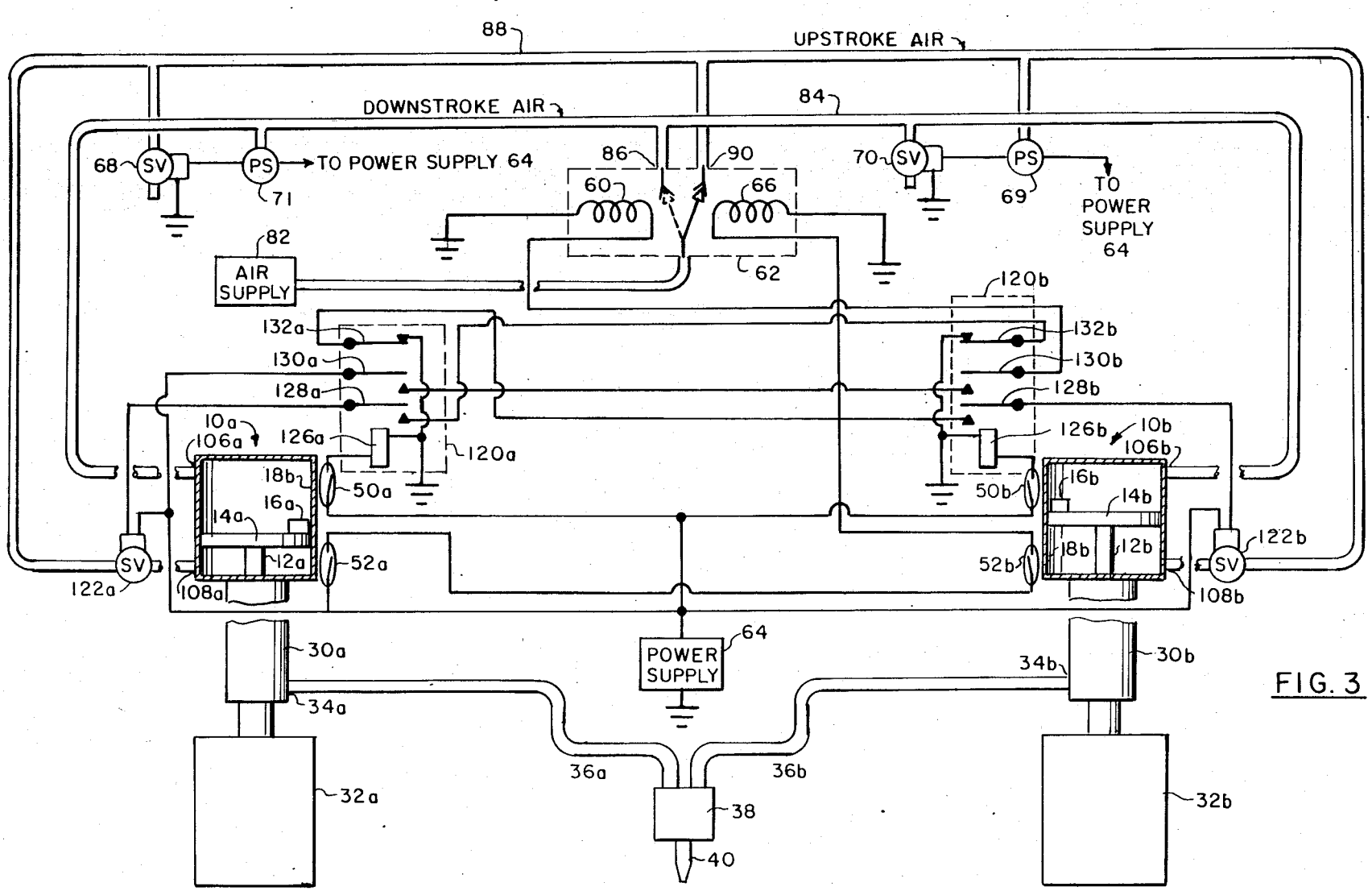
FIG. 3 is a schematic diagram of a further embodiment of the multiple fluid pumping system of the present invention showing a method for using the devices for detecting piston position as the means for regulating piston stroke length.

With reference to FIG. 3, there is illustrated a further embodiment of the present invention in which adjustment screws 20*a* and 20*b* are eliminated.

For the embodiment illustrated in FIG. 3, the top-of-stroke position or piston stroke length is controlled by the location of reed switches 50*a* and 50*b* along the outside of their respective cylinders 18*a* and 18*b*.

By thus controlling the top position of each piston, the length of stroke can be more easily adjusted to more easily adjust for different ratios of fluid volume.

The apparatus for pumping fluids from reservoirs 32*a* and 32*b* in FIG. 3 can be identical to the apparatus shown in FIG. 1 with the exception that a pair of control relays 120*a* and 120*b* are controlled by top-of-stroke reed switches 50*a* and 50*b*, respectively.

In addition, normally open solenoid valves 122*a* and 122*b* are placed in upstroke air conduit 88 proximate ports 108*a* and 108*b*, respectively, of cylinders 18*a* and 18*b*.

The purpose of normally open solenoid valves 122*a* and 122*b* is to hold either piston 14*a* or 14*b* in its top position pending arrival of the the other piston to its top position.

Control relays 120*a* and 120*b* are identical and comprise an actuating solenoid coil 126 (126*a*, 126*b*), two normally open contacts 128 (128*a*, 128*b*) and 130 (130*a*, 130*b*) and one normally closed contact 132 (132*a*, 132*b*).

Where, in FIG. 1, reed switches 50*a* and 50*b* were used to actuate solenoid coils 60 and 66, respectively, of two-position solenoid valve 62, in FIG. 3 reed switches 50*a* and 50*b* are used to actuate solenoid coils 126*a* and 126*b* of control relays 120*a* and 120*b*, respectively.

The contacts of control relays 120*a* and 120*b* are connected to control the flow of air into and out of cylinders 18*a* and 18*b* in a manner similar to that for FIG. 1.

Power supply 64 is connected in parallel to one side of reed switches 50*a*, 50*b* and 52*a*.

The other side of reed switch 52*a* is connected in series to reed switch 52*b* and then to upstroke coil 66 of pneumatic two-position solenoid valve 62.

Power supply 64 is also connected in parallel to one side of normally open solenoid valve 122*a*, one side of normally open relay contact 130*a* (relay 120*a*) and one side of normally open solenoid valve 122*b*.

The other side of normally open solenoid valve 122*a* is connected to one side of normally open relay contact 128*a*.

In a similar manner, the other side of normally open solenoid valve 122*b* is connected to one side of normally open relay contact 128*b*.

Normally open relay contact 128*a* (control relay 120*a*) is connected in series with normally closed relay contact 132*b* (control relay 120*b*) to ground.

In a similar manner, normally open relay contact 128*b* (control relay 120*b*) is connected in series to normally closed relay contact 132*a* (control relay 120) to ground.

Normally open relay contact 130*a* (control relay 120*a*) is connected in series with normally open relay contact 130*b* (control relay 120*b*) to downstroke coil 60 of pneumatic two-position solenoid valve 62.

Operation

To operate the multiple fluid pumping system of FIG. 3, air pressure is supplied to pneumatic two-position solenoid valve 62, in the position shown, providing air to outlet port 90 and air pressure to upstroke air conduit 88.

Pressure in conduit 88 actuates pressure switch 69 which in turn actuates solenoid valve 70 to vent exhaust air from the upper portion of cylinders 18*a* and 18*b* through downstroke conduit to the atmosphere.

As pistons 14*a* and 14*b* are forced upward by air entering ports 108*a* and 108*b*, reed switches 50*a* and 50*b* will remain in the the open or unactuated position.

Control relays 120*a* and 120*b* will also remain in the open or unactuated position as shown in FIG. 3.

Relay contacts 128*a* and 128*b*, which are used to control normally open solenoid valves 122*a* and 122*b*, will also remain in the open position so that air will continue to flow through normally open solenoid valves 122*a* and 122*b* into ports 108*a* and 108*b*, respectively.

As pistons 14*a* and 14*b* rise in cylinders 18*a* and 18*b*, respectively, the drag forces on each piston and positive displacement pump combination will be different due to friction as well as viscous drag forces. This will cause each piston to rise at a different rate of speed.

If, for example, piston 14*a* reaches the top of its stroke before piston 14*b* whereby reed switch 50*a* is actuated by magnet 16*a*, reed switch 50*a* will close causing current to flow from power supply 64 through actuating coil 126*a* of control relay 120*a*.

Upon actuation, normally open relay contacts 128*a* and 130*a* will close and normally closed relay contact 132*a* will open.

When relay contact 128*a* is closed, because it is connected in series with normally closed relay contact 132*b* (control relay 120*b*), solenoid valve 122*a* will be energized to the closed position entrapping the air in the lower portion of cylinder 18*a* thus preventing air from entering or leaving cylinder 14*a* through port 108*a*. Thus piston 14*a* will be held in its top-of-stroke position as determined by the location of reed switch 50*a* along the outside surface of cylinder 18*a*.

Piston 14*b* will continue its upward travel

With relay contact 130*a* closed and relay contact 130*b* still open, no power can be provided to downstroke coil 60 of pneumatic two-position solenoid valve 62 to alter the flow of air to piston 14*b*.

As soon as piston 14*b* reaches the top of its stroke whereby reed switch 50*b* is actuated to the closed position by magnet 16*b*, solenoid coil 126*b* of control relay 120*b* is actuated causing normally open contacts 128*b* and 130*b* to close and normally closed contact 132*b* to open.

In this position, normally open solenoid valve 122*b* would typically be energized to close and entrap air in the lower portion of cylinder 18*b* thus holding piston 14*b* at the top of its stroke.

However, since relay contact 132*a* (control relay 120*a*) is open, and relay contact 128*b* (control relay 120*b*) is connected in series with relay contact 132*a*, solenoid valve 122*b* will not be energized. In addition, since relay contact 132*b* (control relay 120*b*) is now open and is connected in series with relay contact 128*a* (control relay 120*a*) controlling solenoid valve 122*a*, solenoid 122*a* will be de-energized and be cause to open thus allowing air entrapped in the lower portion of cylinder 18*a* to escape to upstroke air conduit 88.

Concurrently, since both contacts 130*a* and 130*b* are now closed, downstroke coil 60 of pneumatic two-position solenoid valve 62 is energized causing air from air supply 82 to be switched to outlet port 86 to provide air pressure to downstroke conduit 84.

In a manner similar to that described for the apparatus of FIG. 1, pistons 14*a* and 14*b* are now driven downwardly to the bottom of their stroke and the pumping cycle is again repeated.

It can be seen, that by adjusting the position of reed switches 50*a* and 50*b* along the outside of their respective cylinders 18*a* and 18*b*, the upward length of piston travel and thus pumping volume can be adjusted.

Furthermore, since neither piston can begin either its upward or downward stroke before the other, any delays in piston travel due to differences in viscosity of the fluids being pumped is automatically compensated for during each piston stroke.

Figure 4:
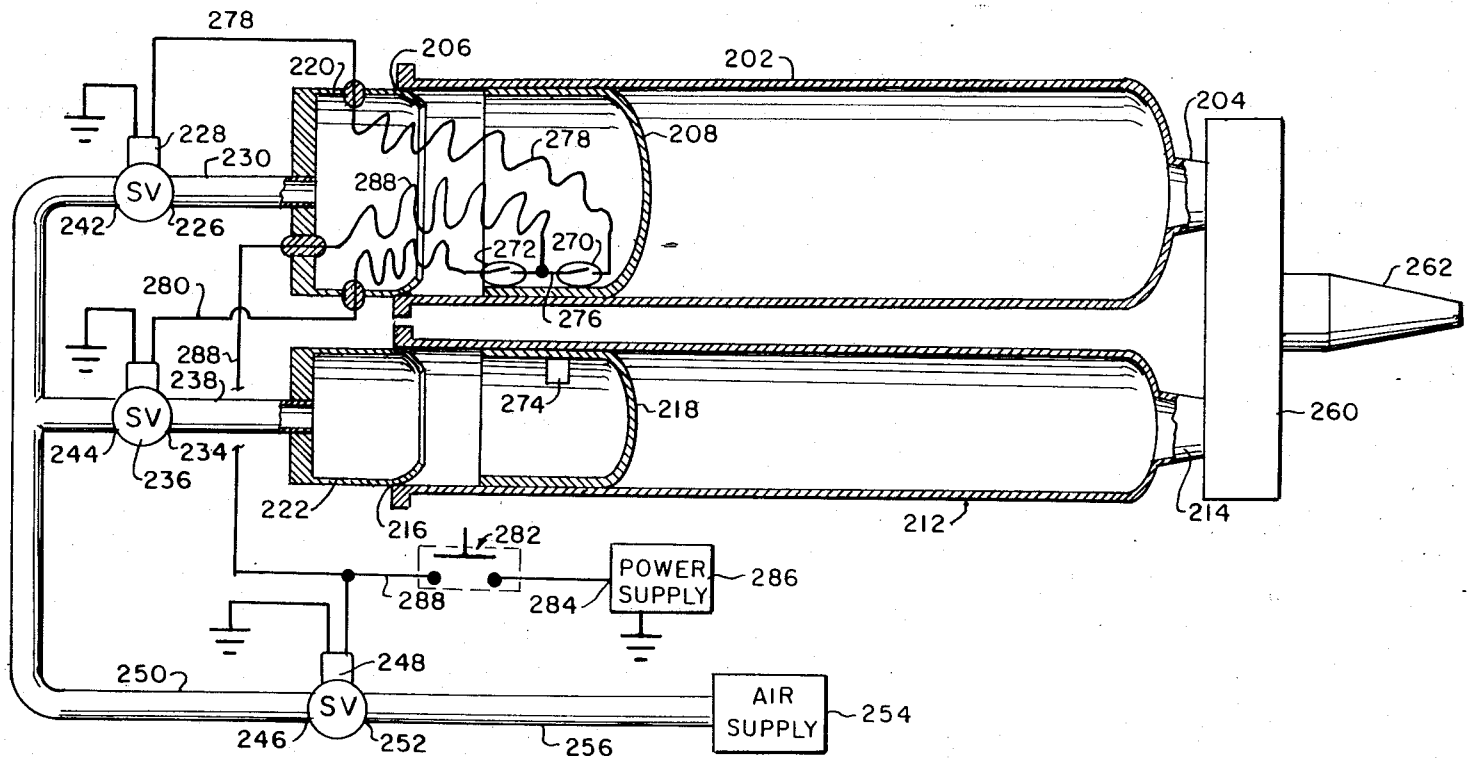
FIG. 4 is a cross-sectional, elevational view of a further embodiment of the present invention utilizing disposable cartridges in which pneumatically driven, disposable plungers are arranged to automatically compensate for differences in fluid viscosities and track each other along the length of the disposable cartridge.

With respect to FIG. 4, there is illustrated a further embodiment of the present invention in which a pair of reed switches are used in conjunction with a permanent magnet to control the movements of plungers in adjacent, parallel disposed, disposable cartridges.

Each cartridge can be of a different diameter but must be of the same length.

For a two-component epoxy resin combination, the ratio of cartridge diameters determines the ratioing of the resin components.

The embodiment illustrated in FIG. 4 comprises, basically, a first disposable cartridge 202 having a necked down top opening 204 and having an open bottom end 206 adapted to receive a disposable first plunger 208, and a second disposable cartridge 212 having a necked down top opening 214 and an open bottom end 216 adapted to receive a disposable second plunger 218.

The bottom end 206 of first disposable cartridge 202 is also adapted to engage the end of first air supply plenum 220 to form an air-tight seal.

The bottom end 216 of second disposable cartridge 212 is also adapted to engage the end of second air supply plenum 222 to form an air-tight seal.

The output side 226 of first plenum solenoid valve 228 is connected in fluid communication with first plenum 220 through conduit 230, while the output side 234 of second plenum solenoid valve 236 is connected in fluid communication with second plenum 222 through conduit 238. The input side 242 of first plenum solenoid valve 228 and the input side 244 of second plenum solenoid valve 236 are connected in common and are in fluid communication with the output side 246 of main air supply solenoid valve 248, through conduit 250, whose input side 252 is in fluid communication with air supply 254 through conduit 256.

Top end or neck 204 of first disposable cartridge 202 and top end or neck 214 of second disposable cartridge 212 are connected in fluid communication and in common to static mixing chamber 260 from which the mixed fluids are ejected through nozzle 262.

In order to detect the relative positions of first plunger 208 and second plunger 218, a first reed switch 270 and a second reed switch 272 are attached to the inside of first plunger 208 and spaced apart longitudinally along plunger 208.

A permanent magnet 274 is attached to the inside of second plunger 218 in magnetic proximity to first and second reed switches 270 and 272, respectively.

First and second reed switches 270 and 272 are electrically connected in series through electrical conductor 276, with one side of first reed switch 270 electrically connected to one side of first plunger solenoid valve 228 through electrical conductor 278 and with one side of second reed switch 272 electrically connected to second plunger solenoid valve 236 through electrical conductor 280. The other side of first solenoid valve 228 and the other side of second solenoid valve 236 are connected to ground.

One side of main air solenoid valve 248 is electrically connected to the load side of normally open pushbutton. The line side of pushbutton 282 is electrically connected to the output side 284 of power supply 286.

The other side of main air solenoid valve 248 is connected to ground.

To supply electrical energy to reed switches 270 and 272, the load side of pushbutton 282 is electrically connected through conductor 288 to conductor 276 which electrically connects reed switches 270 and 272 in series.

Operation

To operate the embodiment of FIG. 4, first and second reed switches 270 and 272, respectively, are attached to the inside of first disposable plunger 208 as by self-adhesive tape or the like. In a similar manner, permanent magnet 274 is attached to the inside of second disposable plunger 218 as by self-adhesive tape or the like.

The bottom end 206 of first disposable cartridge 202 is placed in air-tight sealed relation onto first air plenum 220. In a like manner, the bottom end 216 of second disposable cartridge 212 is placed in air-tight sealed relation to second air plenum 222.

After nozzle 262 is placed in position to inject the adhesive mixture, pushbutton 282 is depressed to electrically connect main air solenoid valve 248 and first and second reed switches 270 and 272, respectively, to power supply 286.

Thus energized, main air supply solenoid valve 248 is actuated to supply pressurized air from air supply 254 to input side 242 of first plenum solenoid valve 228 and input side 244 of solenoid valve 236 through conduit 250.

While pushbutton 282 remains depressed, first reed switch 270 and second reed switch 272 will be supplied a voltage through electrical conductor 288 and series conductor 276.

If magnet 274 is located approximately equidistant between first reed switch 270 and second reed switch 272, both reed switches will be actuated thus providing electrical energy to first plenum solenoid valve 228 and second plenum solenoid valve 236 causing them to be actuated to provide air pressure to first plenum 220 and second plenum 222. The air pressure will then cause first disposable plunger 208 and second disposable plunger 218 to be pushed toward first neck 204 and second neck 214, respectively.

Because of the differences in viscosities of the fluids in each disposable container 202 and 212, the velocities of each plunger will be different whereby one plunger will tend to overtake the other plunger.

Should plunger 218 begin to overtake plunger 208, the magnetic field of magnet 274 will become less effective on second reed switch 276 as magnet 274 moves farther away. At that point, second reed switch 272 will open causing second plenum solenoid valve 236 to close thus cutting off the air supply to plenum 222 and causing plunger 218 to stop advancing any further toward neck 214.

In the meanwhile, air is still being supplied to plenum 220 permitting first plunger 208 to move further toward first neck 204 and to bring second reed switch 272 closer to permanent magnet 274. When second reed switch 272 is again activated by the magnetic field of magnet 274, air is again supplied to plenum 222 causing plunger 218 to resume its movement toward second neck 214.

In a like manner, if first plunger 208 advances toward first neck 204 faster than second plunger 218, reed switch 270 would become inactivated causing first solenoid valve 228 to close thus cutting off the air supply to first plenum 220. This would cause first plunger 208 to stop until the movement of second plunger 218 was sufficient to cause the magnetic field of magnet 274 to actuate first reed switch 270. Thus energized, first plenum solenoid valve would again provide air pressure to first plenum 220 to cause first plunger 208 to resume its movement toward first neck 204.

Thus, first plunger 208 and second plunger 218 are caused to move in unison toward their respective neck ends 204 and 214, independent of any differences in viscosity of the fluids in each disposable container or friction between the plungers and their respective disposable containers.

In some cases it may be desirable to "fine tune" the magnetic field strength of magnet 274. In such case, magnet 274 can comprise an iron core solenoid in which the DC electrical current to the solenoid can be adjusted using a variable resistance, potentiometer or the like (not shown). By "fine tuning" or adjusting the DC current in magnet 274 so that smaller movements of plungers 208 and 218 can be detected by reed switches 270 and 272, the accuracy of ratioing can be further controlled.

Although the apparatus of the present invention has been described in detail, it is intended that the scope of this invention shall not be limited by such detailed description except as provided in the claims.

We claim:

1. A multiple fluid pumping system comprising a first component pump comprising a first fluid reservoir, a first fluid positive displacement pump in fluid communication with said first fluid reservoir, a first pneumatic piston and cylinder combination, said first piston connected to said first positive displacement pump, means for detecting the top-of-stroke position of said first piston, means for detecting the bottom-of-stroke position of said first piston, a second component pump comprising a second fluid reservoir, a second fluid positive displacement pump in fluid communication with said second fluid reservoir, a second pneumatic piston and cylinder combination, said second piston connected to said second positive displacement pump, means for detecting the top-of-stroke position of said second piston, means for detecting the bottom-of-stroke position of said second piston, a pneumatic two-position valve having an air inlet port, a first outlet port in fluid communication with the upper end of said first and second cylinders and a second outlet port in fluid communication with the lower end of said first and second cylinders, an air supply in fluid communication with said inlet port of said pneumatic two-position valve, means for actuating said pneumatic two-position valve to fluidly communicate said inlet port of said valve with said first outlet port of said valve when both of said means for detecting the top-of-stroke position of said first piston and said means for detecting the top-of-stroke position of said second piston have concurrently detected the top-of-stroke of their respective pistons, and means for actuating said pneumatic two-position valve to fluidly communicate said inlet port of said valve with said second outlet port of said valve when both of said means for detecting the bottom-of-stroke position of said first piston and said means for detecting the bottom-of-stroke of said second piston have concurrently detected the bottom-of-stroke of their respective pistons, and means for preventing reverse travel of the piston first to reach the end of its stroke until the other piston has reached the end of its stroke.

* * * * *